US009968835B2

(12) United States Patent
Suwito

(10) Patent No.: US 9,968,835 B2
(45) Date of Patent: May 15, 2018

(54) MULTIPURPOSE GOLF TOOL

(71) Applicant: Aviartech, LLC, West Linn, OR (US)

(72) Inventor: Wantjinarjo Suwito, West Linn, OR (US)

(73) Assignee: AVIARTECH, LLC, West Linn, OR (US)

( * ) Notice: Subject to any disclaimer, the term of this patent is extended or adjusted under 35 U.S.C. 154(b) by 0 days. days.

(21) Appl. No.: 14/721,649

(22) Filed: May 26, 2015

(65) Prior Publication Data

US 2016/0346653 A1 Dec. 1, 2016

(51) Int. Cl.

| | |
|---|---|
| ***A63B 47/02*** | (2006.01) |
| ***A63B 57/00*** | (2015.01) |
| ***A63B 71/00*** | (2006.01) |
| ***A63B 57/20*** | (2015.01) |
| ***A63B 57/30*** | (2015.01) |

(Continued)

(52) U.S. Cl.

CPC ..... *A63B 57/0037* (2013.01); *A63B 47/02* (2013.01); *A63B 57/207* (2015.10); *A63B 57/353* (2015.10); *A63B 57/50* (2015.10); *A63B 60/16* (2015.10); *A63B 71/0009* (2013.01); *A63B 53/14* (2013.01); *A63B 57/203* (2015.10); *A63B 57/357* (2015.10); *A63B 2071/0694* (2013.01);

(Continued)

(58) Field of Classification Search

CPC ..... A63B 57/0037; A63B 57/0068; A63B 57/0075; A63B 47/02; A63B 57/203; A63B 57/357; A63B 60/16; A63B 57/50; A63B 57/22; A63B 57/353; A63B 57/207; A63B 2225/09; A63B 2209/08; A63B 2071/0694; A63B 53/14; A63B 71/00009

See application file for complete search history.

(56) References Cited

U.S. PATENT DOCUMENTS 1,831,268 A * 11/1931 Starks ..... A43B 21/39 36/34 R
4,313,604 A 2/1982 Baxter (Continued)

FOREIGN PATENT DOCUMENTS

GB 2441823 A * 3/2008 ..... A63B 47/02
JP 2005214332 * 8/2005

(Continued)

OTHER PUBLICATIONS

"Golf Ball Pick Up—Halo," Horne Golf, 2009, retrieved from http://www.hornegolf.com/Golf-Ball-Pick-Up-Halo-Halo.htm;jsessionid=5A4EE8C58CFB062F3913CB7E8C12B28A.m1plqscsfapp06, 4 pages.

*Primary Examiner* — Stephen Blau
(74) *Attorney, Agent, or Firm* — Berg Hill Greenleaf & Ruscitti LLP

(57) ABSTRACT

A multipurpose golf tool includes a mounting base that can be secured to the free end of a golf shaft at the golf grip. The mounting base is used to mount selected implements each having multiple capabilities for picking up or securing objects thereby enabling a golfer to retrieve and hold objects without having to kneel or bend over. The selected implements include various embodiments of a ball retrieving and holding cup in, a ball marker retrieving and holding implement, a flagstick pick-up implement, and a golf tee retrieving and holding implement. Multiple implements may be (Continued)

mounted to the mounting base in a stacked configuration, or the implements may be mounted individually.

19 Claims, 13 Drawing Sheets

(51) Int. Cl.
*A63B 57/50* (2015.01)
*A63B 60/16* (2015.01)
*A63B 53/14* (2015.01)
*A63B 71/06* (2006.01)

(52) U.S. Cl.
CPC ..... *A63B 2209/08* (2013.01); *A63B 2225/09* (2013.01)

(56) References Cited

U.S. PATENT DOCUMENTS 4,526,369 A 7/1985 Phelps
4,693,508 A * 9/1987 Pettit ..... B60J 7/041 296/100.03
4,951,947 A 8/1990 Kopfle
5,690,558 A * 11/1997 Huber ..... A63B 47/02 294/19.2
5,772,533 A 6/1998 Dahlmann
6,419,097 B1 * 7/2002 Anderson ..... F41A 23/18 211/85.7
6,638,177 B1 * 10/2003 Wang ..... A63B 47/02 294/19.2
6,749,522 B1 * 6/2004 Aikman ..... A63B 47/02 294/19.2
6,773,021 B2 * 8/2004 Breuer ..... A63C 5/03 280/14.21
6,824,179 B1 11/2004 Shelato
7,086,959 B2 8/2006 D'Agguano
7,134,635 B2 * 11/2006 Burriel ..... F16M 11/043 248/225.11
7,222,451 B2 * 5/2007 Keng ..... F41A 23/08 42/127
7,637,177 B2 * 12/2009 Haab ..... E05D 15/0608 74/89
7,740,193 B2 * 6/2010 Soller ..... A47L 13/22 15/144.1
7,789,765 B2 * 9/2010 Marini ..... A63B 53/007 473/206
8,196,887 B2 * 6/2012 Dahlbacka ..... B60N 2/07 248/424
8,337,322 B2 * 12/2012 Harper ..... A63B 57/50 473/286
8,523,699 B2 * 9/2013 Bennett ..... A63B 47/02 294/19.2
8,679,131 B2 * 3/2014 Bergin ..... A61B 90/06 606/102
2006/0229145 A1 10/2006 Dempsey
2007/0259731 A1 * 11/2007 Barouh ..... A63B 47/02 473/282
2008/0070715 A1 * 3/2008 Barouh ..... A63B 47/02 473/286
2008/0096685 A1 4/2008 Dempsey
2011/0053701 A1 * 3/2011 Eddings ..... A63B 57/00 473/286
2015/0182374 A1 * 7/2015 Stenberg ..... A61C 7/08 128/848
2016/0037870 A1 * 2/2016 Perkins ..... A44B 17/0011 24/664

FOREIGN PATENT DOCUMENTS

JP 2005214332 A * 8/2005
JP 3162281 * 8/2010

* cited by examiner

MULTIPURPOSE GOLF TOOL

FIELD OF THE INVENTION

The invention relates to equipment for playing golf, and more particularly, to a golf accessory tool with multiple functions to enable a golfer to pick up objects while playing golf without having to bend over or kneel.

BACKGROUND OF THE INVENTION

There are numerous golf tools marketed and sold as golf accessories. An expanding golf market in the past few decades coupled with golf being taken up by all ages has resulted in development of a wide variety of golf accessories to satisfy diverse consumer needs.

Golf accessories may include various tools to assist the golfer in maintaining golf equipment or to assist the golfer in playing the game. Examples of golf accessories to assist a golfer in playing the game include the invention described in US 2006/0229145 and US 2008/0096685. These patent references more particularly describe a golf accessory comprising a ball retriever tool on one end of a pole and a ball mark repair tool on the opposite end which facilitates use of both tools without requiring a golfer to bend down. The golf accessory may further comprise telescoping members inside a shaft for extending the golf accessory to various lengths.

While there may be a wide array of golf accessories available in the market, there is still a need to provide an integrated tool that allows a user to pick up various different objects without having to bend over or kneel. A golfer must repeatedly bend down or kneel in order to pick up or place various objects while playing golf. The golf ball typically requires being picked up at every hole along with a golf tee. The golfer may also need to pick up the flagstick and a ball marker numerous times throughout a round of golf. Particularly for elderly golfers or handicapped golfers, the continual and repeated bending or kneeling motion can make an otherwise enjoyable golf round less appealing. Further, for any golfer who may have particular difficulty in reaching down to pick up an object, playing golf without an effective pick-up tool or accessory can make playing golf unnecessarily challenging.

SUMMARY OF THE INVENTION

The invention comprises a multipurpose golf tool enabling a user to pick up a wide variety of objects without having to bend over or kneel. The golf tool includes a mounting base that is used to mount implements for picking up or holding objects. The mounting base may be conveniently secured to the grip portion of a golf club, or a pole/shaft dedicated for use as a pick-up tool component. The mounting base is specifically configured to attach to the grip of the golf club adjacent the end of the grip. The mounting base is of sufficiently small size and minimal weight so that it may remain attached to the golf club while the golf club is being used during golf play.

Pick-up implements or tools associated with the invention include a pick-up cup for picking up golf balls and flagsticks. The pick-up cup has a shape which also facilitates grasping and lifting of a flagstick. The pick-up cup further may further include a ball marker slot especially adapted for placing and removing a ball marker.

Another implement associated with the invention includes a pitch mark repair tool for repairing pitch/ball marks. The pitch mark repair tool also includes a golf tee slot especially adapted for picking up golf tees.

The mounting base may be secured to any other type of pole or shaft, such as one which is specifically dedicated for use as a multipurpose golf tool. Additionally, in another embodiment, a dedicated pole/shaft can be used in which a mounting base is secured to each end of the pole/shaft. For example, the shaft of a used golf club may be separated from the club head and the end of the shaft normally secured to the club head may have a grip attached thereto resulting in a shaft having grips at both ends. In this embodiment, two mounting bases can be attached to single shaft, one at each end, thereby providing additional opportunities for simultaneous mounting of various types of pick-up implements or other golf accessory tools.

In yet another example of a dedicated pole/ shaft, it may further include a telescoping feature in which the pole/shaft is collapsible for storage and extendable for tasks such as ball retrieval from a body of water.

In one preferred embodiment, the mounting base has a protrusion or rail that is placed in a corresponding channel or slot of the pick-up implement or tool that is to be secured to the base. Each pick-up implement or tool is selectively attached and detached from the mounting base.

In another preferred embodiment, the mounting base and the pick-up implements/tools may be provided in a stacked arrangement in which each pick-up implement/tool may be selectively attached and detached from the mounting base, or the pick-up implements/tools may be secured to one another in a stacked arrangement.

In yet another preferred embodiment, the mounting base may include an integral pitch mark repair tool, and the repair tool may be used to attach the mounting base to another implement/tool such as a pick-up cup.

According to yet another embodiment of the invention, a golf pick-up tool is provided in the form of a wire member that includes a looped portion sized to receive and hold a golf ball or an end of a flagstick. The wire member further includes a post and an adjacent extension for securing the wire member to the grip of a golf club or dedicated shaft/ pole.

According to one method of the invention, the mounting base is secured to the end of a golf club or dedicated shaft/rod. The mounting base is a relatively nonintrusive accessory is the golf club grip enabling it to remain attached to the golf club during use of the golf club. One or more pick-up implements or tools may be used with the mounting base in order to achieve different tasks.

Each implement may have multiple functions. A user manipulates the selected implement in order to pick up a desired object. Implements of the invention include those especially adapted to pick up or hold objects including a golf ball, a golf tee, a ball marker, and a flagstick. Another implement may be used to repair pitch/ball marks.

Considering the above features and of the invention, in one aspect, the invention may be considered a multipurpose golf tool comprising: a mounting base having a body, a flange extending substantially perpendicular thereto, and a mounting structure extending from the body; an implement secured to the mounting structure of the mounting base, the implement having a complementary channel for receiving the mounting structure in order to secure the implement to the mounting base; and said implement including at least one of a pick-up cup or pitch mark repair tool.

In another aspect of the invention, it may also be considered a multipurpose golf tool comprising: a shaft; a mounting base secured to said shaft, said mounting base having a body, a flange extending substantially perpendicular thereto, and a mounting structure extending from said body, said body residing on an end of said shaft and said base extending along a selected length of said shaft; and an implement secured to the mounting structure of the mounting base, the implement having a complementary channel for receiving the mounting structure in order to secure the implement to the mounting base, said implement including at least one of a pick-up cup or pitch mark repair tool.

In yet another aspect of the invention, it may also be considered a multipurpose golf tool especially adapted for attachment to a shaft of a golf club or the like, comprising: a mounting base for securing to the shaft, said mounting base having a body, a flange extending substantially perpendicular thereto, and a mounting structure extending from said body, said mounting structure including a pair of spaced prongs extending away from said body and in a direction substantially opposite to said flange.

In yet another aspect of the invention, it may also be considered a multipurpose golf tool especially adapted for attachment to a shaft of a golf club or the like, comprising: a mounting base for securing to the shaft, said mounting base having a body, a flange extending substantially perpendicular thereto, and a flexible latch protruding from said body; and a first implement secured to the mounting structure of the mounting base, said first implement having a pair of spaced prongs extending away from said body and a channel for receiving said flexible latch to connect said first implement to said mounting base.

In yet another aspect of the invention, it may also be considered a ball pick-up tool comprising a shaped member having a looped portion sized to receive and hold a golf ball, a post extending from the looped portion, a stop flange extending away from said post, and a grip extension extending substantially parallel to said post.

Additional features and advantages of the invention will become apparent from a review of the following detailed description taken in conjunction with the drawings.

DETAILED DESCRIPTION

Figure 1:
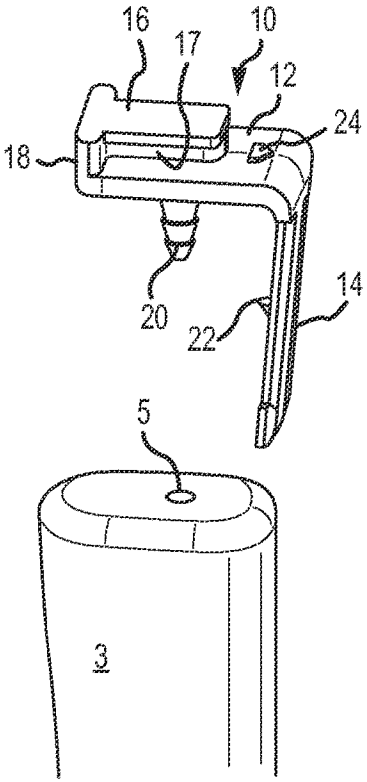
FIG. 1 is a perspective view of a mounting base of the invention prior to attachment to a golf grip.

FIG. 1 illustrates a first preferred embodiment of a component of the invention, namely, a mounting base 10. The mounting base 10 is illustrated adjacent a pole or shaft to which it can be mounted, such as a golf grip 3 of a golf club. The golf grip 3 is attached to the end of a golf shaft in a conventional manner. The golf grip 3 extends a predetermined length down the shaft of the golf club. A golfer typically grasps the golf grip in the middle area of the golf grip between the ends thereof. The mounting base is located near the end of the golf grip so as not to interfere with the golfer's normal grip of the golf club.

The mounting base 10 has a body 12 and an anti-rotation flange 14 that extends substantially perpendicular to the body 12. A primary barb or connector 20 extends from a lower surface of the mounting base 10 as the base is oriented in FIG. 1. The barb 20 is inserted within the vent opening 5 of the grip 3. The upper surface of the body 12 includes a mounting feature used to secure an implement, such as a pick-up cup 40 discussed in more detail with respect to FIG. 3. The mounting feature may include an extension, flange, protrusion, or other type of engaging structure that extends from the body 12. The specific shape of the mounting feature shown in FIG. 1 resembles a T-shaped rail having a wider section 18 and an undercut 17 extending along lateral sides of the rail 16. The body 12 is also shown as including a locking and alignment marker or tab 24 which may visually assist the user in attaching implements to the body 12. Optionally, the flange 14 may be disposed at a slight inward angle so that when the mounting base 10 is secured to the golf grip 3, the secondary mounting barb 22 is able to better hold the golf grip 3.

Figure 2:
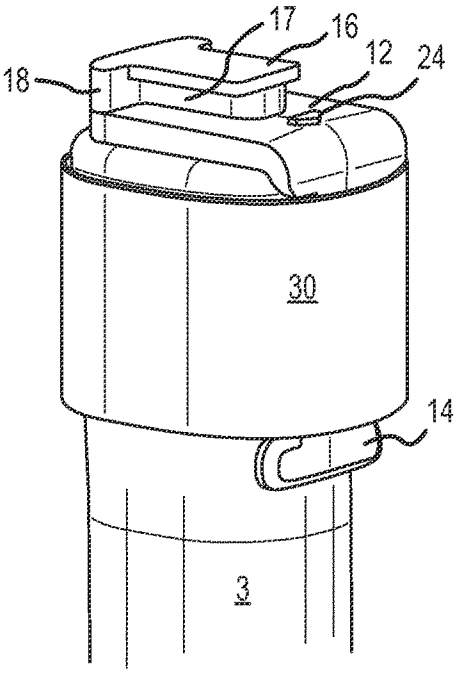
FIG. 2 is an enlarged perspective view showing the mounting base secured to the golf grip.

Referring to FIG. 2, the mounting base 10 is shown in its mounted position to the golf grip 3. The body 12 rests on the end surface of the golf grip, and the mounting barb 20 is inserted within the opening 5. The secondary barb 22 is pressed against the outer surface of the golf grip 3. Optionally, adhesive tape or a flexible rubber band 30 may be used to further stabilize the attachment of the mounting base 10 to the golf grip 3. The element 30 may also represent a heat shrinkable element, such as a heat shrinkable tube, a zip tie, or any other comparable element that may be used to frictionally engage the flange 14 against the golf grip 3. As also shown, the free or distal end of the flange 14 may be exposed.

Figure 3:
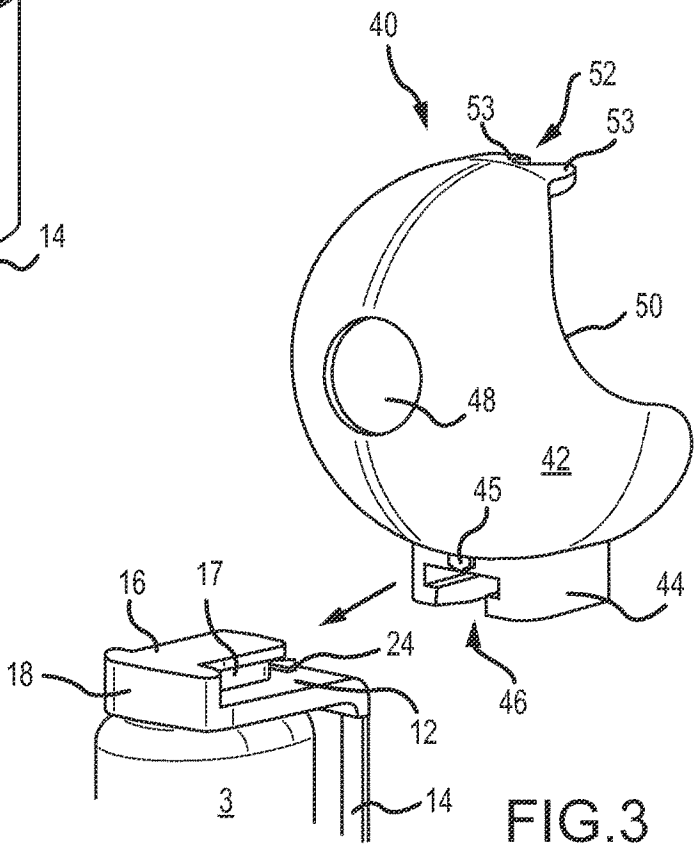
FIG. 3 is a rear perspective view of the mounting base secured to the golf grip and a pick-up implement adjacent the mounting base prior to attachment.
Figure 4:
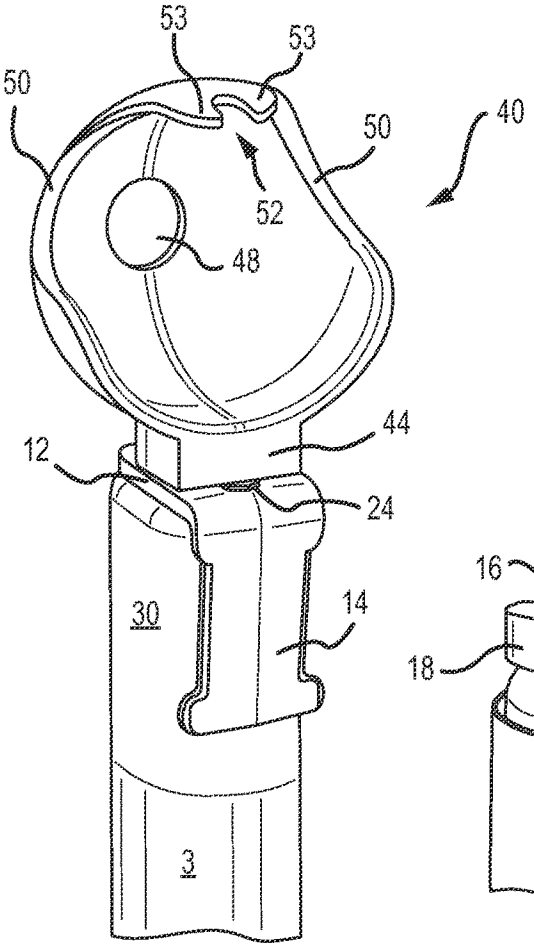
FIG. 4 is a front perspective view of the mounting base secured to the golf grip and the pick-up implement of FIG. 3 secured to the mounting base.

Referring to FIG. 3, an implement 40 is shown that may be secured to the mounting base to perform functions for picking up objects. The implement 40 is a pick-up cup used to pick up a golf ball. The implement 40 has a partial spherical shape body 42 sized to receive a golf ball. Opening 48 is formed on the body 42, and may serve to drain water if a ball is retrieved from a body of water. A base 44 of the implement 40 includes a T-shaped slot or cavity 46 used to attach the implement 42 the mounting base 10. An alignment marker 45 on the body 42 is aligned with a corresponding marker 24 on the mounting base 10. The rail 16 is then inserted within the channel 46 to attach the implement 40. As shown in FIG. 4, when mounted, the base 44 of the implement 40 rests on the upper surface of the body 12. Each side of the body 42 includes a pair of cutouts or slots 50 that are sized to receive an object such as a flagstick, as discussed below with respect to FIG. 10. The implement 40 also has a ball marker slot 52 which can be used to and to pick up and to place a ball marker used to mark a golf ball on a golf green. The slot 52 is formed between two small fingers or projections 53 located at the top end of the body 42 as it is oriented in FIGS. 3 and 4.

Figure 6:
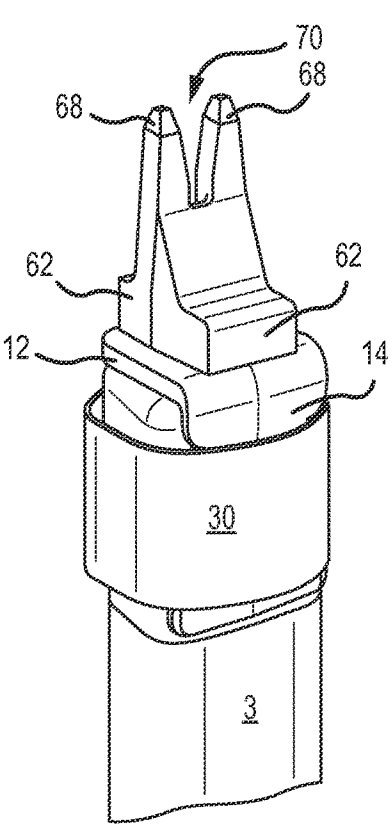
FIG. 6 is a front perspective view of the mounting base secured to the golf grip and the pick-up implement of FIG. 5 secured to the mounting base.
Figure 5:
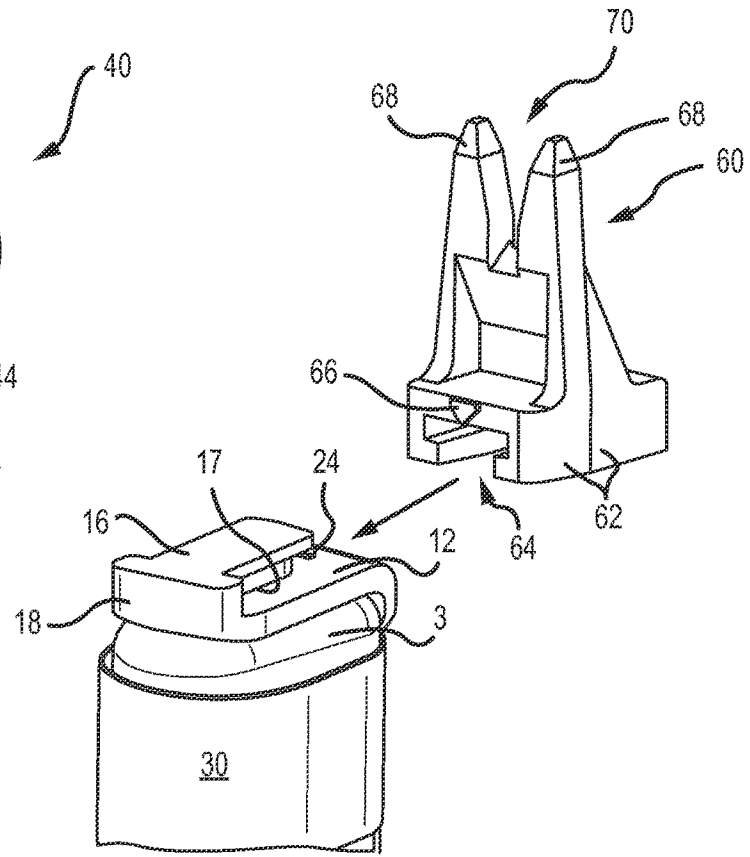
FIG. 5 is a rear perspective view of the mounting base secured to the golf grip and another pick-up implement adjacent the mounting base prior to attachment.

Referring to FIGS. 5 and 6, another implement 60 is illustrated, namely, a pitch mark repair tool 60. The repair tool 60 has two spaced prongs 68 that are mounted to a base 62. A slot 70 defines the space between the prongs 68. An alignment marker 66 can be used to align the implement for attachment to the mounting base 10. Like the implement 40, the implement 60 also includes a T-shaped slot or channel 64 which receives the t-shaped rail 16 of the base 10. When mounted, the base 62 of the implement 60 rests on the upper surface of the body 12.

Figure 7A:
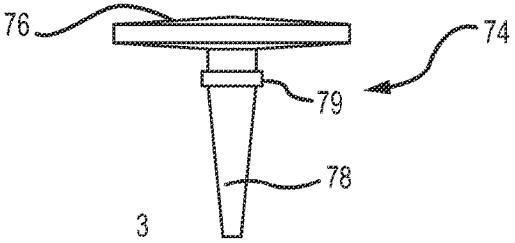
FIG. 7A is an exemplary ball marker that may be used with the implement.
Figure 7:
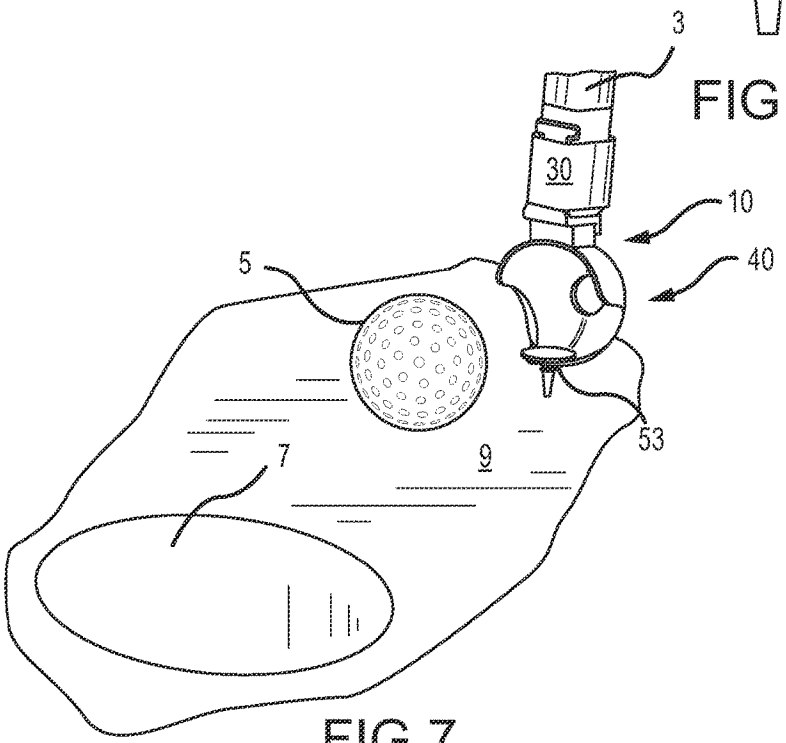
FIG. 7 is a perspective view of the pick-up implement of FIG. 3 in use for holding a ball marker.

Referring to FIG. 7, the implement 40 is shown with a ball marker 74 received in the ball marker slot 52. When the golf grip is oriented substantially vertical, this allows the ball marker 74 to be positioned for placement for removal in a golf green 9. One example of a type of ball marker that may be used is shown in FIG. 7A. This exemplary ball marker includes a top marking plate 76 and a stem 78. The projections 53 may be frictionally fitted in the space between the flange 79 of the stem 78 and the lower surface of the plate 76. Also shown in FIG. 7 is a golf ball 5 in which the body 42 of the implement 40 is conveniently sized to effectively retain and hold a golf ball.

Figure 8:
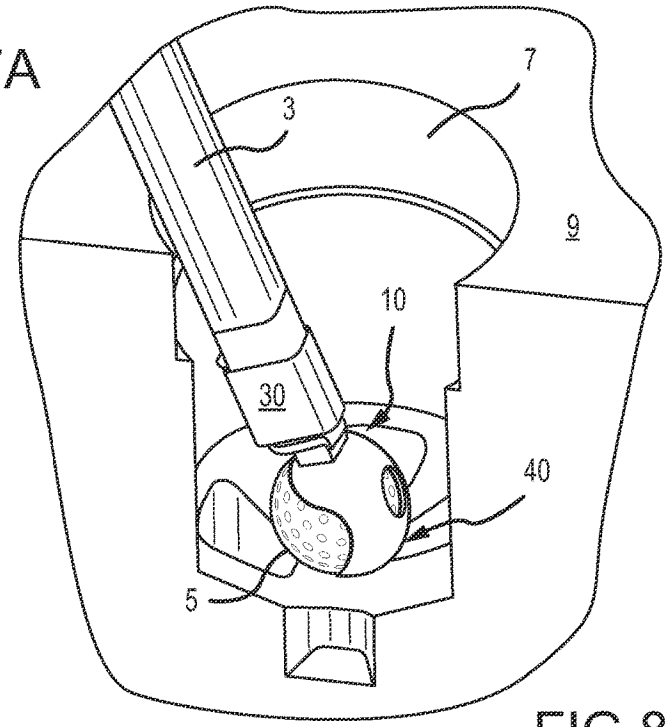
FIG. 8 is a perspective view of the pick-up implement of FIG. 3 in another use, namely, picking up a ball from within a golf cup.

Referring to FIG. 8, a golf ball 5 is shown as being retrieved from a golf cup 7. The implement is inserted within the golf cup 7, and the body 42 of the implement 40 is positioned to retrieve the golf ball 5. The implement is manipulated so to place the ball 5 within the spherical opening of the body 42.

Figure 9:
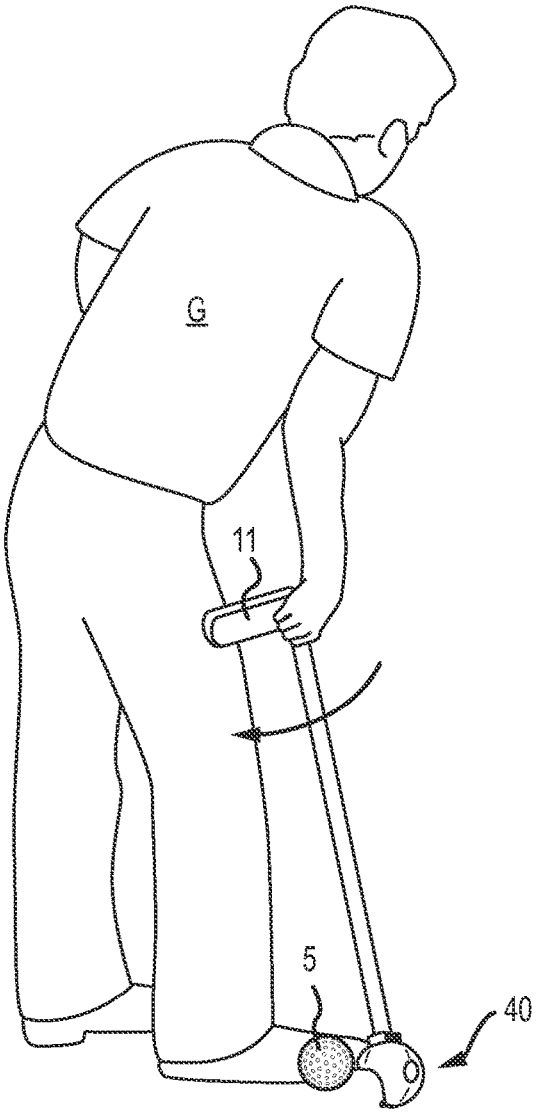
FIG. 9 is a perspective view of the pick-up implement of FIG. 3 in another use, namely, picking up a ball on the ground.

Referring to FIG. 9, it is intended to illustrate how a golf ball 5 may be retrieved by the implement 40 if the ball is on the ground. In this example, the golfer G may position the golf ball 5 between the golfer's foot and the implement 40. The implement 40 is then placed over the golf ball 5 while the foot of the golfer holds the one side of the golf ball 5 in place so the implement may easily capture the ball.

Figure 10:
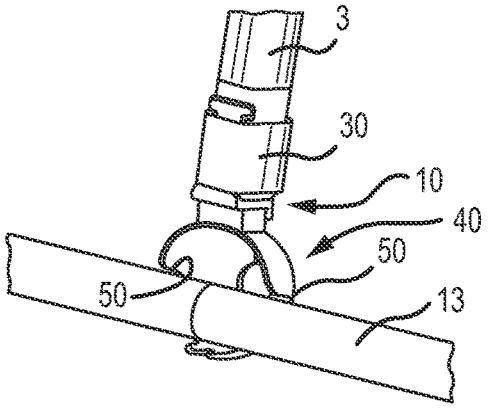
FIG. 10 is a perspective view of the pick-up implement of FIG. 3 in yet another use, namely, picking up a flagstick.

Referring to FIG. 10, it illustrates how the implement 40 may grasp and hold a flagstick 13. As shown, the golf stick 13 is oriented substantially perpendicular to the golf grip 3, and the implement 40 is maneuvered to place the golf stick 13 so that it is held in the slots 50 as shown. In this configuration, the golfer may simply lift up on the shaft to which the golf grip is attached.

Figure 11:
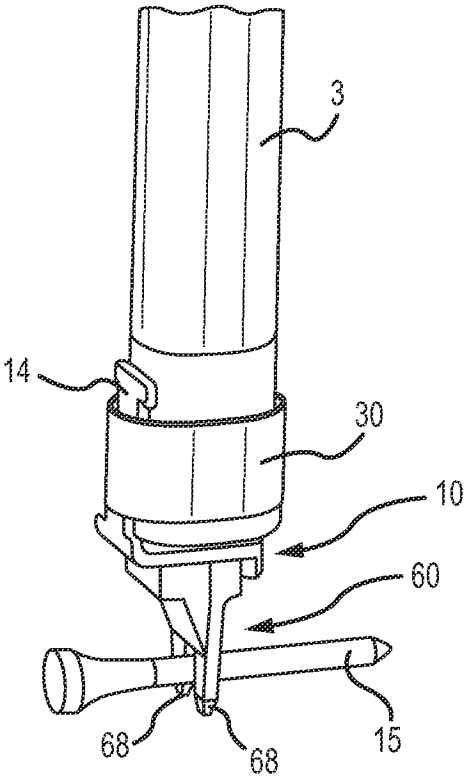
FIG. 11 is a perspective view of the pick-up implement of FIG. 4 in use, namely, holding a golf tee.

Referring to FIG. 11, the pitch mark repair tool 60 is illustrated in which a golf tee 15 is held between the prongs 68. The spacing between the prongs 68 is selected so that a standard golf tee may be frictionally held within the slot 70 between the prongs. The device can be oriented such that the prongs straddle the golf tee 15, whether the golf tee is lying flat on the ground, or whether the golf tee is in the ground. Application of a slight force to move the golf tee 15 between the prongs 68 allows a golfer to capture the golf tee.

Figure 12:
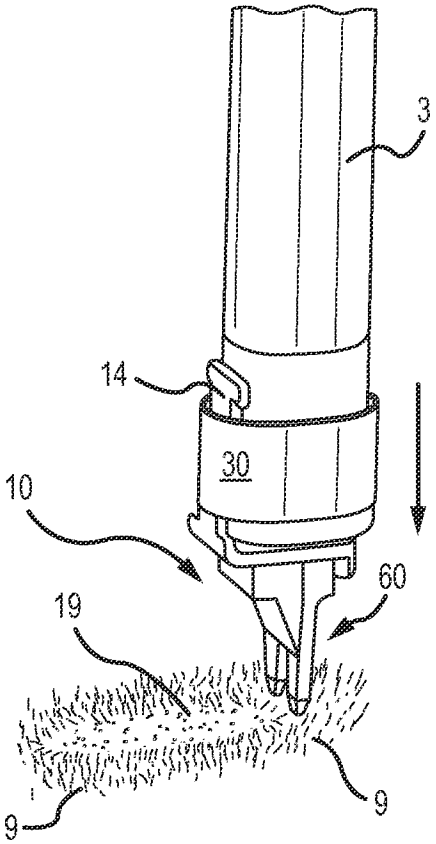
FIG. 12 is a perspective view of the pick-up implement of FIG. 4 in use, namely, repairing a ball or pitch mark.

Referring to FIG. 12, the implement 60 is illustrated as it may be used to repair a pitch/ball mark or divot 19, as these may typically be created on a golf green by the force of balls landing on the green. The golfer takes the prongs 68 and inserts them in the ground around the divot 19. The device is then rotated so that the prongs 68 may lift the earth above the prongs, thereby repairing the divot.

Figure 13:
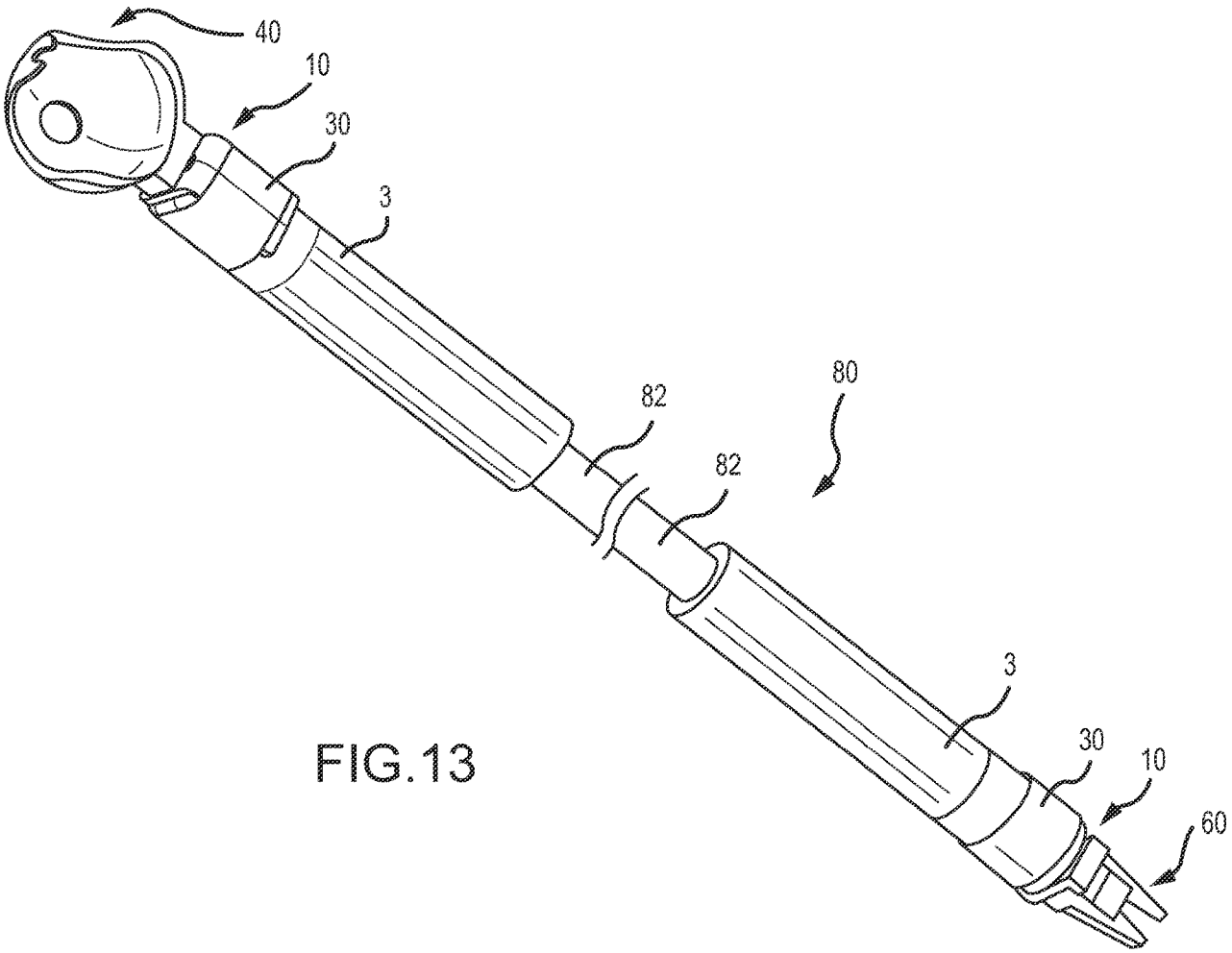
FIG. 13 is a perspective view of another embodiment of the invention, namely, a dedicated multipurpose tool having implements mounted on both ends thereof.

Referring to FIG. 13, another embodiment of the invention is illustrated in the form of a dual handled pole or shaft 80 in which an implement is mounted to both ends of the shaft. A golf grip 3 is mounted to each end of the shaft as shown. A mounting base 10 is then secured to each of the golf grips 3, as shown. Optionally, grip tape or an elastic band 30 may be used to further secure the mounting bases 10 to the golf grips 3. The portion of the shaft 80 between the golf grips 3 may be a telescoping shaft 82, or simply a static shaft of a selected length. With the embodiment of FIG. 13, this provides a user with additional options for attending to the golf game in which multiple tools or functions are provided on a single shaft.

Figure 14:
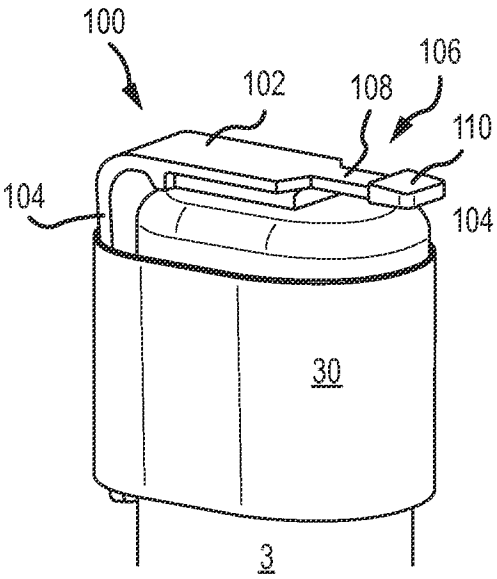
FIG. 14 is a perspective view of another embodiment of the invention, namely, a mounting base secured to a golf grip for a stackable tool configuration.

Referring to FIG. 14, an additional embodiment is illustrated for a mounting base 100. The mounting base 100 of FIG. 4 is characterized as having similar elements to the mounting base 10 including a body 102 and an anti-rotation flange 104. However, the rail 16 is replaced in favor of a flexible latch 106 having a neck 108 and a capture tab 110. The neck 108 and capture tab 110 extend beyond the body 102.

Figure 16:
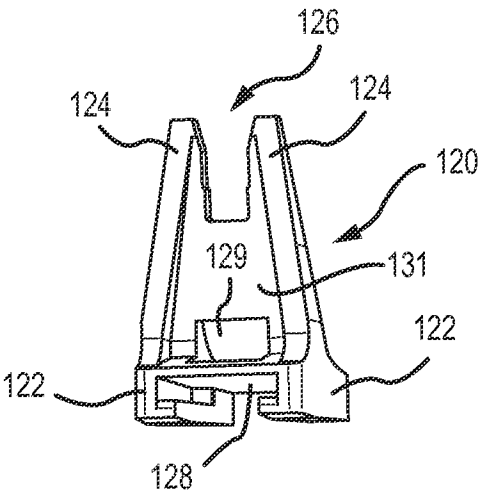
FIG. 16 is a rear perspective view of the first implement shown in FIG. 15.
Figure 15:
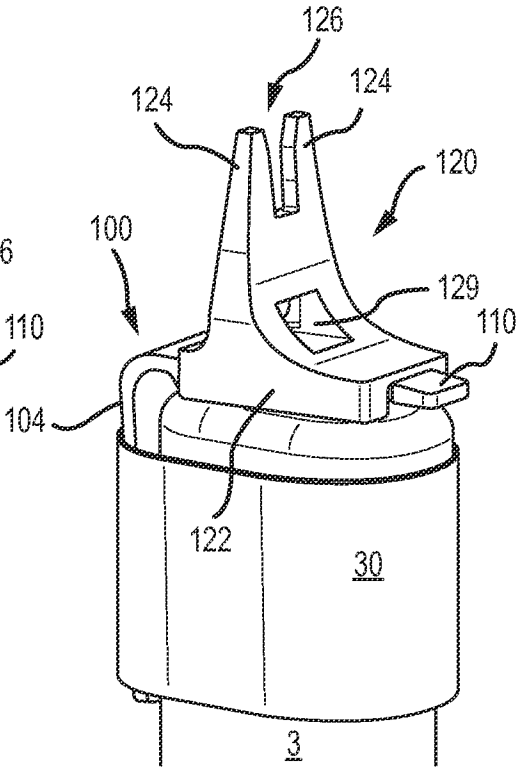
FIG. 15 is a front perspective view of the mounting base of FIG. 14 secured to the golf grip and a first implement secured to the mounting base.

Referring to FIGS. 15 and 16, another embodiment is illustrated with respect to a pitch mark repair tool 120. The tool 120 has similar elements to the implement 60 including spaced prongs 124, a gap 126 defining the space between the prongs 124, and a base 122 with a T-shaped channel 128. The construction of the tool 120 differs in that the tool is integrally formed with the mounting base 100, and has a central opening 129 that is used for mounting of the implement 130 in a stacked arrangement, as discussed with respect to FIGS. 17 and 18. The tool 120 also differs in the way in which the tool is retained by the mounting base 100. The neck 108 and tab 110 are inserted through the channel 128 such that the tab 110 extends completely through the channel 128, and the tab 110 is latched against the front or forward edge of the base 122. In this regard, the tab 110 may snap into place since the neck 108 acts as a resilient spring. In order to remove the implement 120, the tab 110 is slightly depressed so that the tab may then pass it back through the channel 128.

Figure 17:
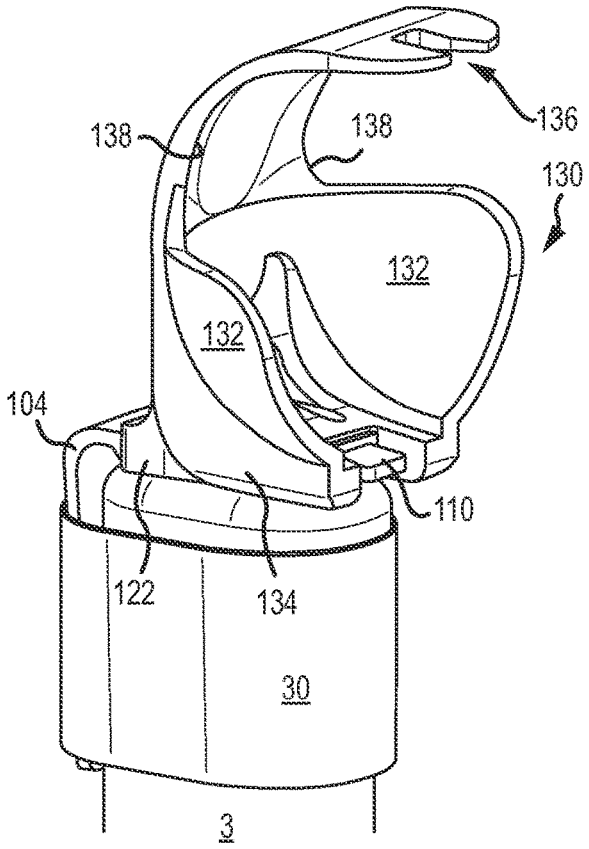
FIG. 17 is a front perspective view of the mounting base and first implement of FIG. 15 secured to the golf grip, and a second implement stacked on the first implement.
Figure 18:
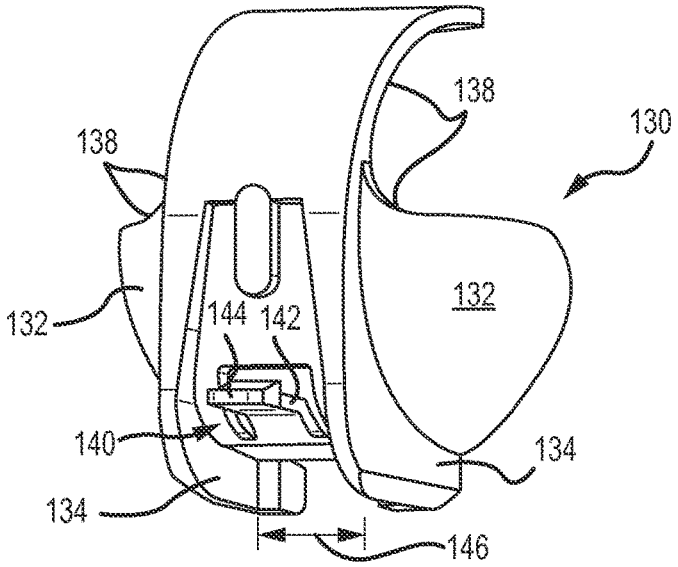
FIG. 18 is a rear perspective view of the first implement shown in FIG. 15.

Referring to FIGS. 17 and 18, another implement 130 is shown as an additional embodiment for a pick-up cup. The structure of the pick-up cup in this embodiment is similar to the implement 40 in terms of having a partial spherical shaped body 132, opposing flagstick slots 138, and a ball marker slot 136. The differing structure in this embodiment includes the arrangement of the base 134, which can be characterized as a pair of mounting legs spaced apart from one another a distance 146. This embodiment further includes a flexible latch 140 having a neck 142 and retention tab 144. In order to attach the implement 130, the neck 142 and tab 144 are inserted within the central opening 129 of the implement 120. The distance 146 between the mounting legs is adapted to receive the base 122 of the implement 130. Like the neck 108, the neck 142 is also resilient and therefore enables the tab 144 to snap in place against the rear surface 131 of the implement 120. To remove the implement 130 from its engaged position with the implement 120, the tab 144 is slightly depressed so that the tab may then pass back through the central opening 129.

Figure 19:
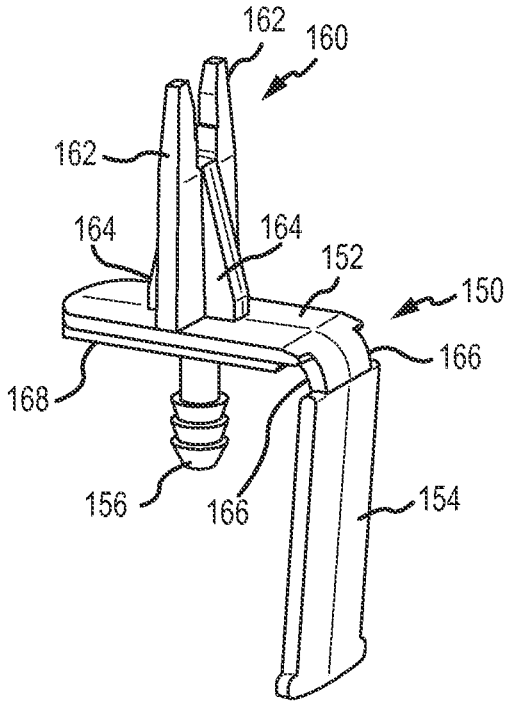
FIG. 19 is a perspective view of yet another embodiment, namely, a multipurpose tool with an integral repair tool that serves dual purposes for repairing greens and as a mounting structure for other implements to be mounted to the tool.
Figure 20:
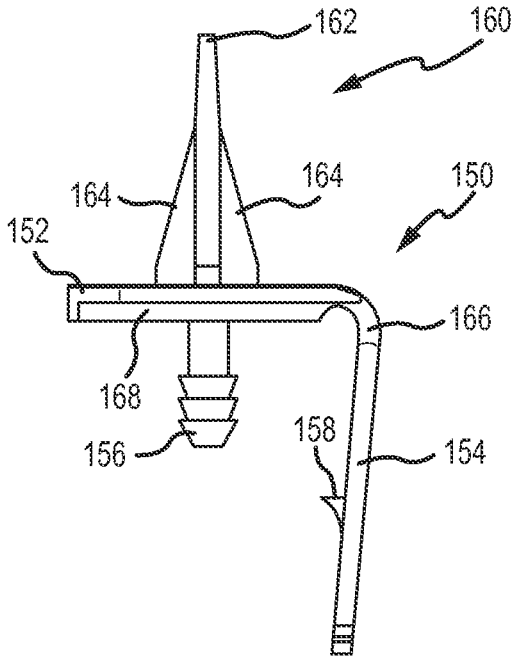
FIG. 20 is a side elevation view of FIG. 19.

Referring to FIGS. 19-24, yet another embodiment is illustrated for a mounting base 150, and this mounting base 150 incorporates an integral pitch mark repair tool 160 that has two primary purposes. One purpose is for use of the tool 160 to repair pitch/ball marks, and the other purpose is for use of the tool 160 as mounting structure for attachment of another tool or implement, such as a pick-up cup. Referring to FIGS. 19 and 20, the mounting base 150 has some similar elements as the other mounting bases, namely, a body 152, an anti-rotation flange 154, a primary mounting barb 156, and a secondary mounting barb 158. The mounting structure used to attach implements to the mounting base 150 in this embodiment includes a pitch mark repair tool 160 that is integrally formed with the body 152 as shown. The repair tool 160 comprises spaced prongs 162 that are especially sized and spaced for use in repair of golf greens or other surfaces of a golf course. Similar to the embodiment shown in FIGS. 15-16, the spaced prongs 162 extend away from the body in a direction substantially opposite to the anti-rotation flange 154. Also, the spacing between the prongs 162 may be sized to accommodate securing the neck of a golf tee. Optionally, supports or braces 164 are provided to stabilize the prongs 162 in their extended position from the body 152. Other features of the mounting base 150 are shown as opposing grooves 166 and an undercut/channel 168, which are provided for receiving another implement or tool.

Figure 21:
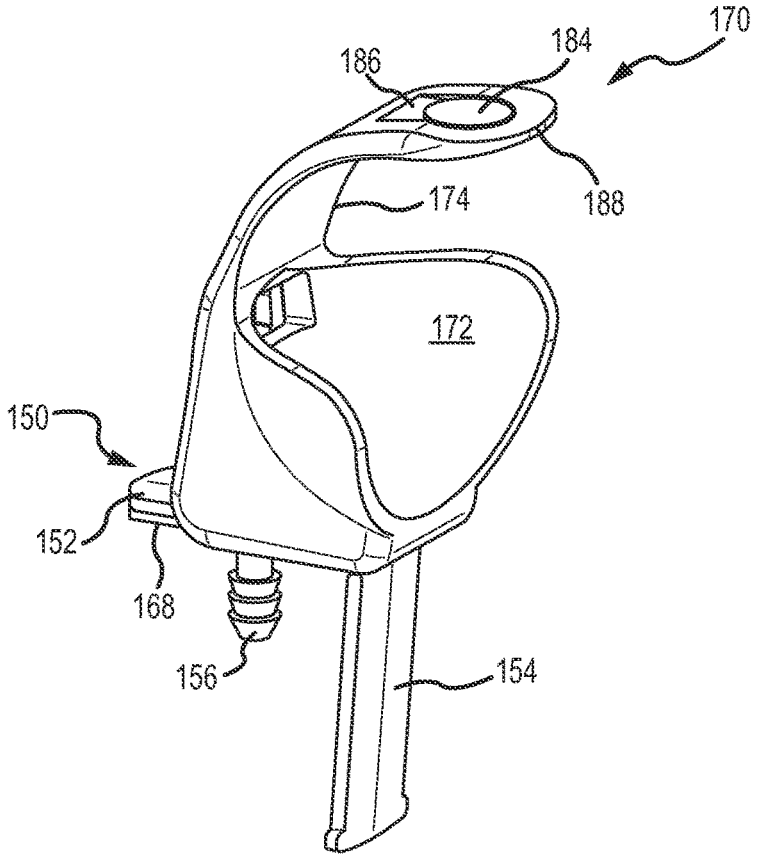
FIG. 21 is a front perspective view of a pick-up implement secured to the tool of FIG. 19 by prongs of the repair tool.
Figure 22:
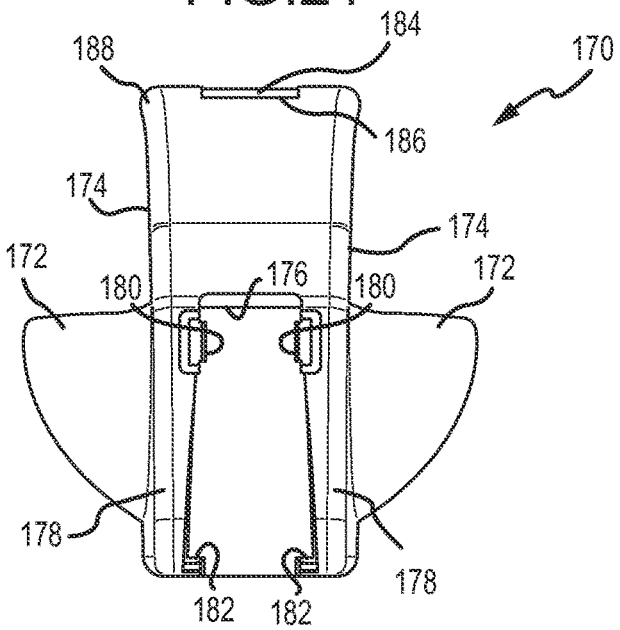
FIG. 22 is a rear view of the pick-up implement of FIG. 21 showing details thereof.
Figure 23:
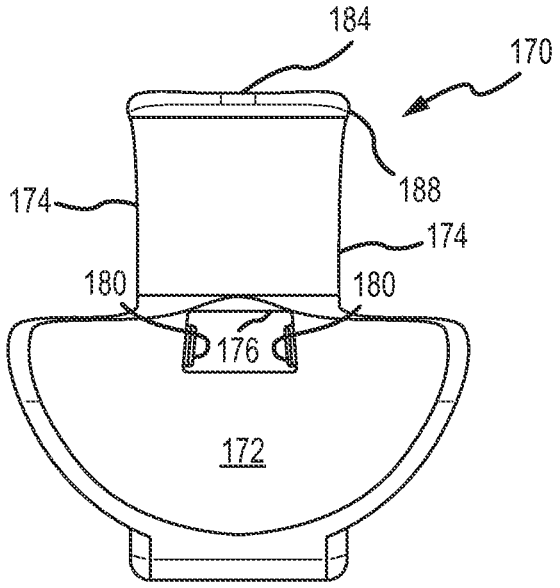
FIG. 23 is a front view of the pick-up implement of FIG. 21 showing details thereof.
Figure 24:
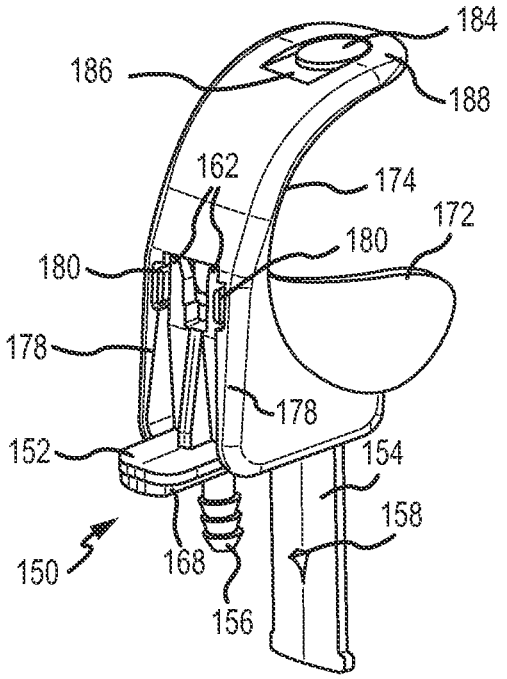
FIG. 24 is a rear perspective view of the pick-up implement secured to the tool of FIG. 19.

Referring also to FIGS. 21-24, a pick-up cup 170 is shown, and FIGS. 21 and 24 more specifically illustrate the pick-up cup 170 secured to the mounting base 150. The pick-up cup 170 is also similar in structure to the pick-up cups 40 and 130 in that it also includes a cup or bowl portion 172 and a flagstick slot 174. The flagstick slot 174 forms a pair of cup wings or extensions having upper edges that extend substantially horizontal according to the view in FIG. 21. The unique features to this pick-up cup 170 collectively include the opening 176, the slotted mount portion 178, the latches 180, and the projections 182. As best seen in FIGS. 22 and 24, the slotted mount portion 178 is formed on the rear portion of the tool 170 and has two spaced receiving rails or frames that are sized and spaced to receive the prongs 162 of the pitch mark repair tool 160. In order to attach the pick-up cup tool 170, the lower portion of the tool 170 is first aligned with the body 152 such that the projections 182 engage the undercut/channels 168, enabling the mount portion 178 to abut the prongs 180. The latches 180 are slightly spread apart to make a snap-fit with the upper portions of the prongs 162, thus resulting in a secure connection of the tool 172 to the base 150. The latches 180 will naturally spread apart from one another as they come in contact with the forward edges of the prongs 162 when the tool 170 is gently pushed into its locked position. In order to unlock and remove the tool 170, a user may hold and press down the exposed end of the body 152 of the base 150 with one hand, grab the cup wings of the cup 172 with the other hand, and then slide the cup 170 out from its engagement with the undercut/channel 168 of the base 150.

Optionally, the pick-up cup tool 170 may further include a ball marker 184 that can be secured in a corresponding slot or depression 186 that is formed in the overhanging portion 188 of the pick-up cup 170. Therefore, one should appreciate that this embodiment provides a mounting base with an integral and structurally robust pitch mark repair tool that can also be used to secure the mounting base to another implement or tool, such as a pick-up cup.

Figure 25:
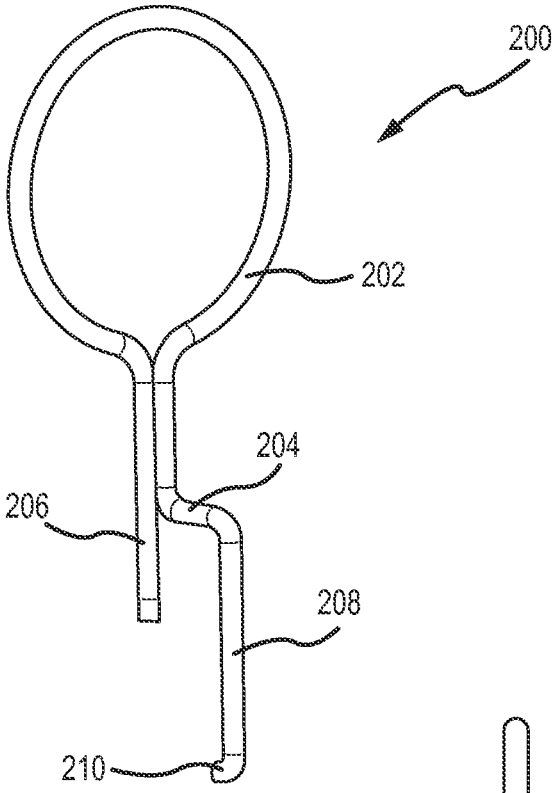
FIG. 25 is a perspective view of yet another embodiment, namely, a golf pick-up tool in the form of a wire member.
Figure 26:
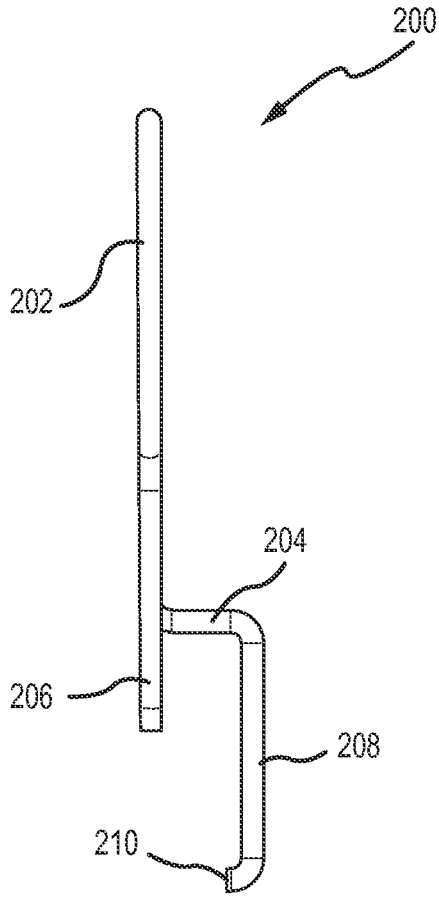
FIG. 26 is a side elevation view of the wire member of FIG. 25.
Figure 27:
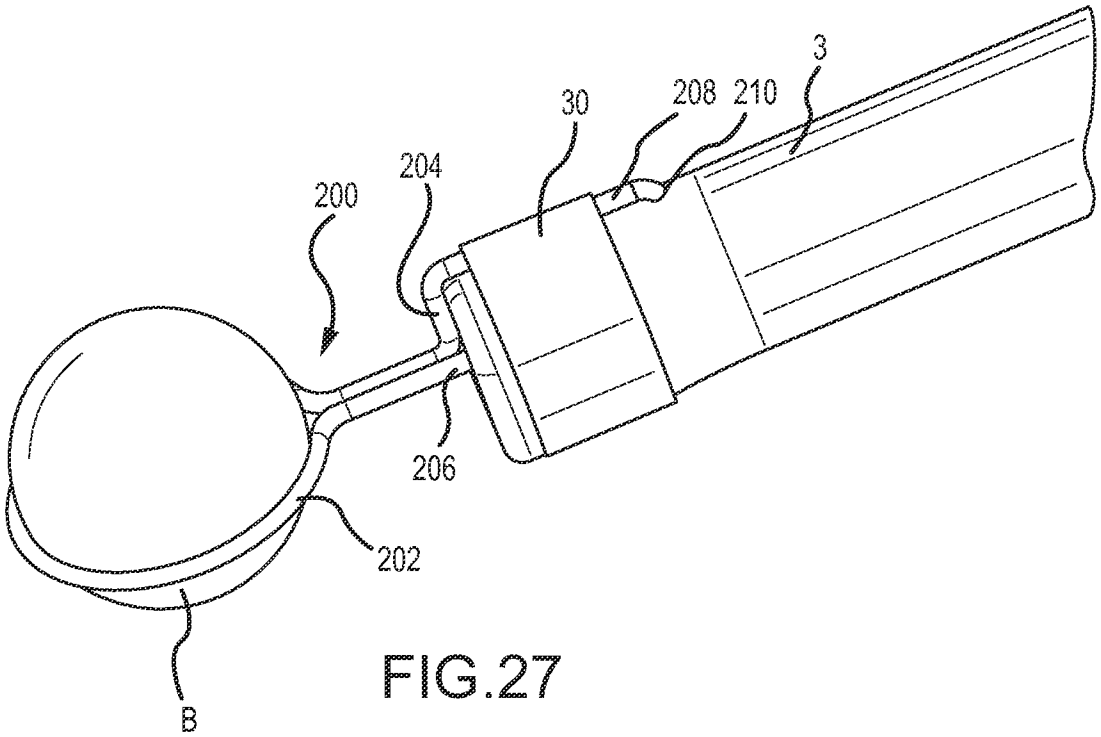
FIG. 27 is a perspective view of the wire member secured to the golf grip of a golf club or dedicated pole.

Referring to FIGS. 25-27, yet another embodiment is illustrated in the form of a ball pickup tool 200 formed of a material such as metal wire. The tool 200 has a looped portion 202 which is sized to receive and hold a golf ball, as shown in the example of FIG. 27. A post 206 of the tool is inserted within the vent opening of the golf grip 3. A stop flange 204 extends substantially perpendicular to the post 206, and is sized to capture the corresponding edge of the golf grip 3. A grip extension 208 extends beyond the stop flange 204, and is substantially parallel to the post 206. The free or distal end of the extension 208 may include a slight inward anchor or protrusion 210, which makes firm contact with the golf grip 203 to further stabilize attachment of the tool 200. Optionally, grip tape or a rubber band 30 may be used to further stabilize attachment of the tool 200 to the golf grip 3.

While the tool 200 is especially adapted in size/diameter to receive a golf ball, the looped portion 202 can also be used to pick up other things such as flagsticks, golf clubs, or anything else that may fit within the circular shaped gap within the looped portion 202. Further, the tool 200 may be magnetized so that it can pick up small metallic objects such as ball markers, coins, and others. Yet, further, if there are slight differences in the sizes of golf ball to be picked up, a flexible, polymeric tube (not shown) can be slipped over the looped portion 202 to adjust the size/diameter of the circular shaped gap within the looped portion. For example, a British golf ball may be slightly smaller than standard PGA sized golf ball; therefore, the polymeric tube could be used in this circumstance.

As one should appreciate, the tool 200 is easily and simply attached to the golf grip 3, and provides a nonintrusive solution for picking up balls or retrieving balls. The tool 200, of course, can also be used with a dedicated pole/shaft, and one which may also incorporate a telescopic feature enabling the tool 200 to be used as an effective ball retrieving tool.

There are many advantages to the invention described herein. A solution is provided for picking up objects while playing golf which can eliminate the need for a golfer to kneel or bend over to pick up objects. The mounting base is easily adapted for attachment to the golf grip of a golf club, or a dedicated rod or extension. Each of the implements has multiple functions, and is adaptable for picking up or holding objects in various positions. Each of these advantages is achieved with a relatively simple yet reliable design construction. If it is desired to keep the mounting base attached to the golf club, this is achievable without materially altering the weight or feel of the golf club. The mounted position of the mounting base at the free end of the golf grip provides a convenient yet nonintrusive location for which to make the tool available for use.

While the foregoing invention has been described with respect to multiple preferred embodiments, it shall be understood that the invention is not strictly limited to these embodiments, and the scope of the invention should be considered in conjunction with the scope of the claims appended hereto.

What is claimed is:

1. A multipurpose golf tool comprising:

a mounting base having a body, a flange extending substantially perpendicular thereto, and a mounting structure including a rail having a length, an end and an upper surface along the length, wherein the upper surface of said rail has a wider part at the end of the length compared to the rest of the upper surface of said rail;

an implement secured to the mounting structure of the mounting base, the implement having a complementary shaped channel for receiving the mounting structure in order to secure the implement to the mounting base; and said implement including at least one of a pick-up cup or pitch mark repair tool, and said implement having a base extending away from said implement, with the channel formed in the base such that the base rests on said body of said mounting base.

2. The multipurpose golf tool of claim 1, wherein:

said pick-up cup has a partially spherical shaped body especially adapted for retrieving and holding a golf ball.

3. The multipurpose golf tool of claim 2, wherein:

said partially spherical shaped body further includes a pair of flag stick slots formed on opposite sides of said body.

4. The multipurpose golf tool of claim 1, wherein:

said pitch mark repair tool includes a pair of spaced prongs.

5. The multipurpose golf tool of claim 1, wherein:

said pick-up cup has a partially spherical shaped body especially adapted for retrieving and holding a golf ball and a ball marker slot.

6. The multipurpose golf tool of claim 1, wherein:

said rail includes a T-shaped rail.

7. The multipurpose golf tool of claim 6, wherein:

said T-shaped rail includes a wider section and an undercut formed below an upper surface of the T-shaped rail.

8. The multipurpose golf tool of claim 1, wherein:

said mounting base and said implement each have alignment marks to enable sight alignment of the base and implement for attachment to one another.

9. The multipurpose golf tool of claim 1, wherein:

said mounting base further includes a primary barb attached to said body.

10. The multipurpose golf tool of claim 9, wherein:

said mounting base further includes a secondary barb attached to said flange.

11. A multipurpose golf tool comprising:

a shaft;

a mounting base secured to said shaft, said mounting base having a body, a flange extending substantially perpendicular thereto, and a mounting structure extending from said body, said mounting structure including a rail having a length, an end and an upper surface along the length and, said body residing on an end of said shaft and said flange extending along a selected length of said shaft, wherein the upper surface of said rail has a wider part at the end of the length compared to the rest of the upper surface of said rail; and an implement secured to the rail of the mounting base, the implement having a complementary shaped channel for receiving the rail in order to secure the implement to the mounting base, said implement including at least one of a pick-up cup or pitch mark repair tool and said implement having a base extending away from said implement, with the channel formed therein such that the base rests on said body of said mounting base.

12. The multipurpose golf tool of claim 11, wherein:

said mounting base further includes a primary barb attached to said body.

13. The multipurpose golf tool of claim 12, wherein:

said mounting base further includes a secondary barb attached to said flange.

14. The multipurpose golf tool of claim 11, wherein:

said pick-up cup has a partially spherical shaped body especially adapted for retrieving and holding a golf ball.

15. The multipurpose golf tool of claim 11, wherein:

said pitch mark repair tool includes a pair of spaced prongs.

16. The multipurpose golf tool of claim 11, wherein:

said pick-up cup has a partially spherical shaped body especially adapted for retrieving and holding a golf ball and a ball marker slot.

17. The multipurpose golf tool of claim 11, wherein:

said rail includes a T-shaped rail.

18. The multipurpose golf tool of claim 11, wherein:

said partially spherical shaped body further includes a pair of flag stick slots formed on opposite sides of said body.

19. The multipurpose golf tool of claim 11, wherein:

said mounting base includes two mounting bases, one mounting base mounted at each end of said shaft.

* * * * *